United States Patent [19]

Hackett

[11] 4,449,313

[45] May 22, 1984

[54] ANNUNCIATING TRIGGER DEVICE

[76] Inventor: John G. Hackett, 2414J Rustic Ridge, Overland, Mo. 63114

[21] Appl. No.: 281,357

[22] Filed: Jul. 8, 1981

[51] Int. Cl.[3] ..... F41C 19/00

[52] U.S. Cl. ..... 42/69 R

[58] Field of Search ..... 42/1 A, 1 B, 7, 69 B, 42/69 R, 70 A

[56] References Cited

U.S. PATENT DOCUMENTS

| | | | |
|---|---|---|---|
| 698,440 | 4/1902 | Brown | 42/69 R |
| 1,285,885 | 11/1918 | Younger | 42/69 R |
| 4,295,289 | 10/1981 | Snyder | 42/1 A |

*Primary Examiner*—Richard E. Schafer

*Assistant Examiner*—Maureen T. Ryan

*Attorney, Agent, or Firm*—Haverstock, Garrett & Roberts

[57] ABSTRACT

A trigger assembly for a trigger operated device including two trigger members movable between an aligned and and out of alignment condition in response to a predetermined condition of the device being monitored, a releasable catch holding the trigger members in their aligned condition, and a tripping mechanism operable to release the catch when the predetermined condition being monitored occurs. The trigger assembly may also include a reset mechanism for restoring the trigger members to their aligned condition when the condition being monitored is restored to some desired condition.

17 Claims, 11 Drawing Figures

ANNUNCIATING TRIGGER DEVICE

The present invention relates to an assembly for use with a trigger operated device for transmitting a condition change in the device to an operator member for the device.

Rath U.S. Pat. No. 4,151,670 is the closest known prior art and discloses a firing mechanism for semi-automatic firearms having a safety lever which protrudes into the trigger guard assembly of the firearm to be felt by the finger of the shooter for indicating when the gun is cocked. The Rath construction provides a separate member adjacent the trigger of the firearm to indicate a condition in the firearms, but does not change the feel of the trigger to indicate a change in condition as in the present construction. The present construction includes a two part trigger having a main trigger member and an annunciating trigger member, which members in the normal untripped position are flush with one another and present a normal feeling trigger to the operator, and the present device is usable in many different trigger operated devices such as firearms, paint sprayguns, cameras, chain saws, and the like. The annunciating trigger member is tripped by a change in some condition in the device, such as when the supply of ammunition, paint, film, or fuel runs low, or the device becomes overheated, or when some other monitored condition occurs. When this occurs it moves the annunciating trigger member a sufficient distance relative to the main trigger member to present a different feel to the user or operator of the device. This is an indication to the user to take some action such as to obtain another cartridge clip and so forth.

It is a principal object of the invention to teach the construction and operation of a trigger assembly for use in a trigger operated device for annunciating a change in some condition in the device by changing the feel of the trigger assembly responsive to the changed condition.

It is another object to teach the construction and operation of a trigger assembly for use in a trigger operated device which includes means to change the feel of the trigger to the operator upon the occurrence of some condition such as a reduction in consumables available to be used by the device such as running out of ammunition, paint, film, fuel and so forth.

It is another object to teach an annunciating trigger assembly which is automatically reset when the device is reloaded, recharged, or refueled.

Another object is to prevent the user of a trigger operated device from running out of material being discharged or dispensed without advanced notice.

Another object is to give advanced warning when the supply of a product being dispensed or discharged under control of a trigger is running low.

Another object is to provide an annunciating trigger that can be installed in an existing device or can be included as original equipment.

Another object is to provide a relatively inexpensive device for use in trigger operated devices to alert the operator to the occurrence of some condition.

These and other objects and advantages of the present invention will become apparent after considering the following detailed specifications of preferred embodiments in conjunction with the accompanying drawings wherein.

Figure 1:
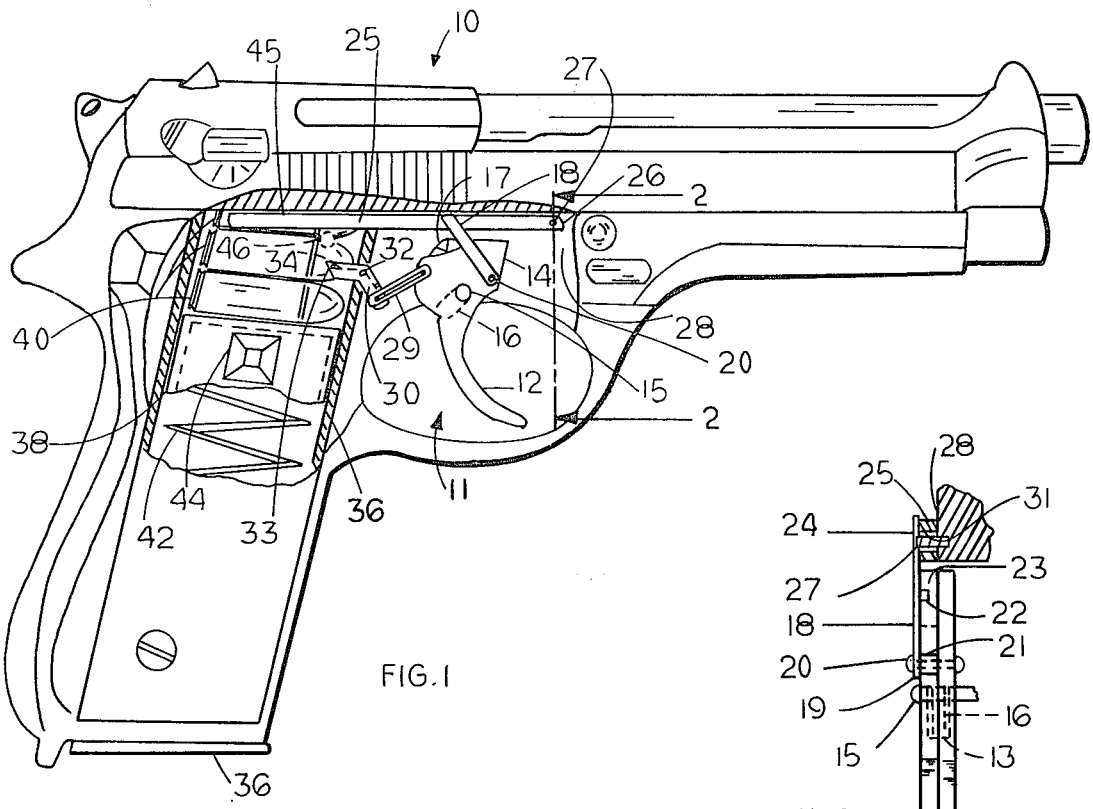
FIG. 1 is a side-elevational partially sectioned view of a clip loaded pistol incorporating one embodiment of an annunciating trigger assembly constructed according to the present invention.

Referring to the drawings more particularly by reference numbers, number 10 in FIG. 1 identifies a clip loaded semi-automatic pistol having an annunciating trigger assembly 11 and the associated mechanism constructed according to one embodiment of the present invention. The particular pistol 10 shown is similar to the Beretta model 92S-1 although the subject invention can be used with almost any known clip or magazine loaded firearm.

Figure 3:
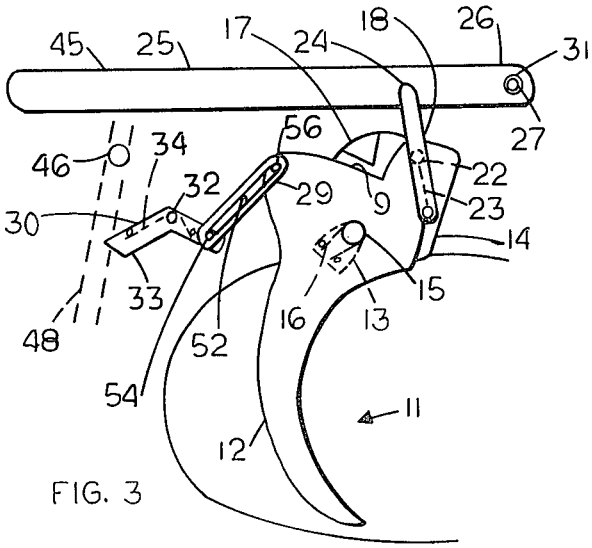
FIG. 3 is a side elevational view of the same trigger assembly of FIGS. 1 and 2 shown in its actuated or firing condition.

The trigger assembly 11 of the pistol 10 includes an annunciating trigger member 12 and a main trigger member 14 mounted on the pistol 10 to be rotatable about a pivot such as pivot pin 15 from a normal inoperative position as shown in FIG. 1 to a firing position as shown in FIG. 3 when the operator or shooter pulls on or squeezes the trigger members 12 and 14 in the usual manner. The firing mechanism per se is not a part of the present invention and therefore, except for the trigger assembly 11, is not shown.

Figure 4:
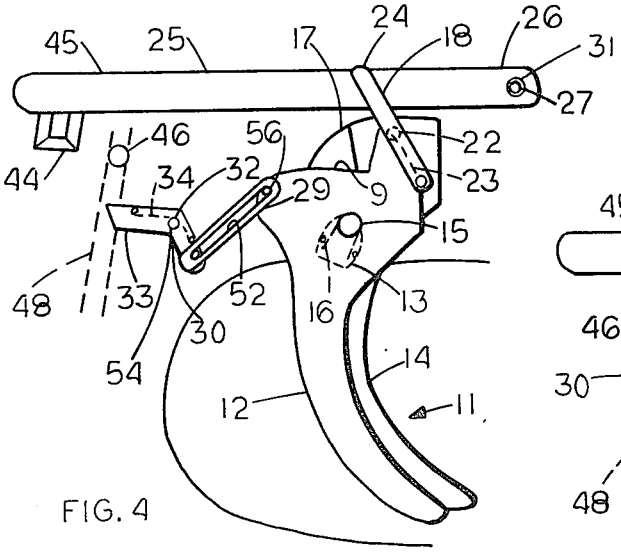
FIG. 4 is a side elevational view of the same trigger assembly shown in its annunciating position.
Figure 5:
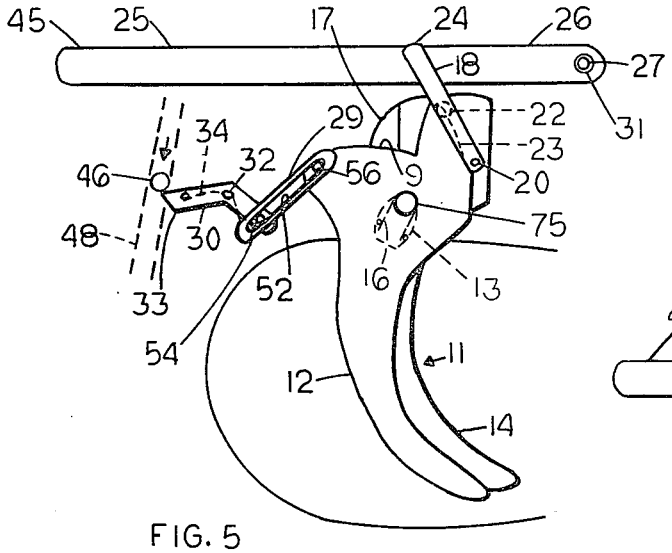
FIG. 5 is a side elevational view of the same trigger assembly shown with the ammunition clip being removed from the pistol.
Figure 6:
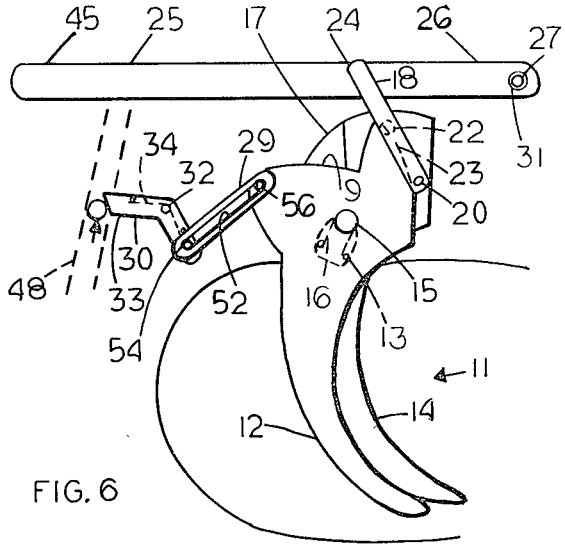
FIG. 6 is a side elevational view of the same trigger assembly with an ammunition clip being loaded into the pistol and resetting the trigger assembly.

In addition to the trigger members 12 and 14 being rotatable around the pin 15 from their inoperative position to their firing position, they are also rotatable with respect to each other from an aligned unactuated position as shown in FIGS. 1 and 3, to an out-of-aligned or actuated or annunciating position as shown in FIGS. 4–6. The members move from the aligned to the out-of-alignment position to indicate the occurrence of some monitored condition such as the reduction in the amount of cartridges remaining in the magazine below some specified condition. The trigger members are continually biased toward the annunciating position by a spring 16 which is located in cavity 13 between the trigger members 12 and 14 as will be more fully explained.

Figure 2:
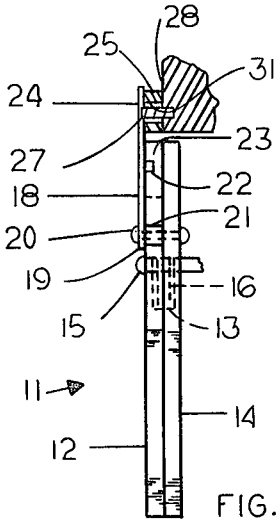
FIG. 2 is a front elevational view partly in section of the trigger assembly of the pistol of FIG. 1, taken along lines 2—2 therein.

The trigger members 12 and 14 are held in the aligned unactuated position as shown in FIGS. 1–3 by a projection or stub 22 that extends from one side of a spring loaded, elongated member 18 toward the main trigger member 14 and into engagement with a face 23 of the annunciating trigger member 12 as shown in FIGS. 2 and 3. In the illustrated embodiment, the elongated member is attached adjacent to one end 19 to the main trigger member 14 by pin 20 which extends through a tubular spacer 21 such that when the free end 24 of the spring member 18 is moved outwardly, the member 18, which is made of a spring material, will bend moving the extension 22 out of engagement with the face 23 thereby allowing the spring 16 between the trigger member 12 and 14 to rotate the annunciating trigger member 12 with respect to the main trigger member 14 to the annunciating position as shown in FIGS. 4–6. A stop 17 is formed on the main trigger member 14 and is engagable by an edge 9 of the annunciating trigger member 12 when it moves to the annunciating position, thereby maintaining the trigger members 12 and 14 in their annunciating or out-of-alignment position which is easily detectable or sensed by the finger of a shooter warning him that only some predetermined number of rounds, such as one round, remains in the pistol magazine. Thereafter, when the trigger members 12 and 14 are moved back into alignment by a reset mechanism to be discussed later, the spring member 18 returns to its original condition as shown in FIG. 2, moving the projection 22 into engagement with the face 23.

The free end 24 of the spring member 18 extends from the trigger members 12 and 14 and is slidably engagable with a deflection bar 25 having a hinged connection at one end 26. The bar 25 is movable to pivot around the hinged end 26, thereby moving the free end 24 of the member 18 outwardly and disengaging the projection 22 from the face 23 as previously described. The hinged connection is formed between the end 26 of the deflection bar 25 and the frame 28 of the pistol 10 in the illustrated embodiment by a pin 27 positioned through an enlarged hole 31 in the end 26 of the bar 25 and into the frame 28. It will be understood that the slidable engagement between the end 24 of the spring member 18 and the deflection bar 25 will maintain the end 26 and the hole 31 therethrough over the pin 27.

A reset linkage member 29 extends from the annunciating trigger member 12 to a reset bell crank 30 which pivots about a pin 32. The bell crank 30 has a tapered end 33 whose function will be discussed later, and is biased by a reset spring 34 to a normal operating position as shown in FIG. 1.

The pistol 10 includes a clip or magazine 36 which has a follower 38 for pushing rounds of ammunition 40 into the pistol 10 under control of the spring 42. An activating cam 44 is attached to the follower 38 and rides in a slot through the case of the clip (not shown) and extends outwardly from the clip 36. The activating cam 44 engages the free end 45 of the deflection bar 25 when the last round in the clip 36 is chambered in the pistol 10, moving the deflection bar 25 outwardly a sufficient distance to actuate the annunciating trigger member 12 as described.

A reset projection 46 on the side of the clip 36 moves along the dotted lines 48 shown in FIGS. 3–6 during movement of the clip 36 into and out of the pistol 10 for engagement with the tapered end 33 of the bell crank 30. This engagement resets the annunciating trigger member 12 with respect to the main trigger member 14 as the loaded clip is inserted into the pistol 10.

The linkage member 29 has an elongated slot 52 in which pins 54 and 56 respectively connected to the bell crank 30 and the trigger member 12 are captured and moved. When the trigger assembly 11 is moved from its normal inoperative position shown in FIG. 1 to its firing position as shown in FIG. 3, its angular rotation about the pin 15 causes the pins 54 and 56 to rotate the bell crank 30 on the pin 32 between the position shown in FIG. 1 to the position shown in FIG. 3. Thereafter, when the trigger assembly 11 is released by the trigger finger of a shooter, the trigger assembly 11 moves back to its normal inoperative position, and the bell crank 30 is moved by the spring 34 back to the position shown in FIG. 1.

When the trigger member 12 moves to its annunciating position as shown in FIGS. 4–6, the pins 54 and 56 move to the respective ends of the slot 52 and in so doing also pull the linkage member 29 in such a way that it pivots the bell crank 30 on the pin 32 placing the tapered end 33 thereof in the path 48 of the reset projection 46. Subsequently, when the clip 36 is removed to reload the pistol, the reset projection 46 moves downwardly along the path 48 striking the top of the tapered end 33 of the bell crank 30 as shown in FIG. 5. This pivots the bell crank 30 counterclockwise allowing the captured pins 54 and 56 to move toward each other along the slot 52 in the linkage member 29 to absorb the rotation of the bell crank 30 as the clip 36 is removed from the pistol 10. When the reset projection 46 has moved passed the tapered end 33, the spring 34 rotates the bell crank 30 back to the position shown in FIG. 4 with the tapered end 33 in the path 48 of the reset projection 46 so that when a new clip is inserted, the projection 46 thereon will move against the bottom of the tapered end 33 as shown in FIG. 6. As the clip 36 is loaded into the pistol 10, the reset projection 46 will rotate the bell crank 30 in the clockwise direction causing the pins 54 and 56 to move to the respective opposite ends of the slot 52 thereby pulling on the linkage member 29 and the annunciating trigger member 12 connected thereto until the trigger member 12 is pulled into alignment with the main trigger member 14. When the trigger members 12 and 14 are thus moved into alignment with one another, the spring member 18 moves to its normal inoperative position, and the extension 22 engages the surface 23 of the trigger member 12 to hold the trigger members 12 and 14 in alignment thereby resetting the trigger assembly 11 in its unactuated condition as shown in FIG. 1.

Figure 7:
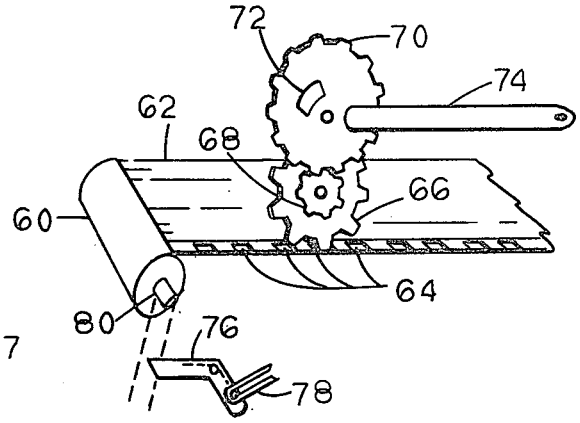
FIG. 7 is a diagramatic illustration of another embodiment of the subject tripping and reset mechanism being used with a camera.

FIG. 7 illustrates another embodiment of the invention specifically operable for use with a camera that has a film cassette 60 holding a length of film 62, which film is moved past a shutter mechanism (not shown) by means which engage a series of sprocket holes 64 located along at least one edge of the film 62. A sprocket wheel 66, which may be part of the film drive mechanism or may be a separate wheel, is provided for engagement with the sprocket holes 64 such that when the sprocket wheel 66 rotates, the film 62 will be advanced through the camera. A spur gear 68 is mounted on and rotates with the sprocket wheel 66, and engages another spur gear 70 on which is mounted an activating cam 72. The activiating cam 72 rotates with the spur gear 70 until it engages a deflection bar 74 that moves and releases an annunciating trigger member 84 shown in FIGS. 8 and 9 in a manner similar to that described in connection with FIGS. 2–6.

The mechanism of FIG. 7 is shown including a reset bell crank 76 and a reset linkage 78 which is activated by a shaft 80 on the cassette 60 when the cassette 60 is loaded into the camera. The action of the bell crank 76 and the linkage 78 is similar to the reset mechanism described above in connection with FIGS. 2–6. The position of the cam 72 on the spur gear 70, and the ratio of the diameters of the spur gears 68 and 70 are arranged such that the cam 72 will not engage the deflection bar 78 until some predetermined amount of film is left in the cassette 60. The embodiment of FIG. 7 may be used with still cameras, movie cameras, or video cameras as desired, and may be used with a button type shutter release or with a trigger release such as discussed in connection with FIGS. 2–6.

Figure 8:
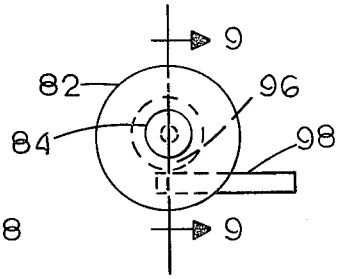
FIG. 8 is a front elevational view showing another embodiment wherein the trigger is in the form of a button type operator member.
Figure 9:
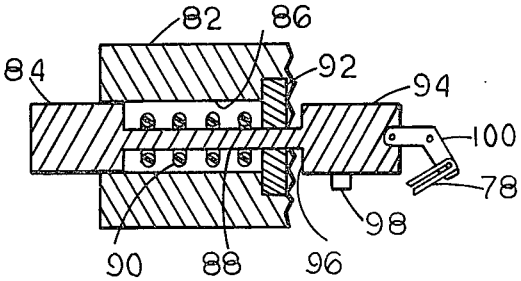
FIG. 9 is a cross-sectional view taken along lines 9—9 of FIG. 8.

FIGS. 8 and 9 show one embodiment of a button type shutter release 82 usable with a camera or like device as described in connection with FIG. 7. This embodiment includes a rod member 84 slidably located in a bore 86 through the button release device 82. The rod member 84 has a reduced cross-section portion 88 around which is a coil spring 90 located in the bore between the member 84 and as fixed member 92 so as to urge the rod 84 toward an extended position as shown in FIG. 9. The fixed member 92 forms a bearing member for one end of the spring 90.

The rod 84 has an enlarged portion 94 which has a surface 96 thereon that normally engages a releasable catch member 98 when the rod 84 is in its retracted position. The catch member 98 moves out of engagement with the surface 96 under control of the deflection bar 74 of FIG. 7 to enable the spring 90 to move the rod 84 to its extended or annunciating position. This occurs to indicate to the user of the camera that only a predetermined amount of unexposed film remains in the cassette 60. A reset member 100 is provided and is activated by the reset linkage 78 to reset the rod 84 to its normal or operating position when a new cassette is positioned in the camera. Note, however, that in all embodiments of the invention, actuation of the annunciating condition provides an indication of some condition such as a low remaining supply of some material, but it does not prevent continued use of the remaining, but diminished, supply.

Figure 10:
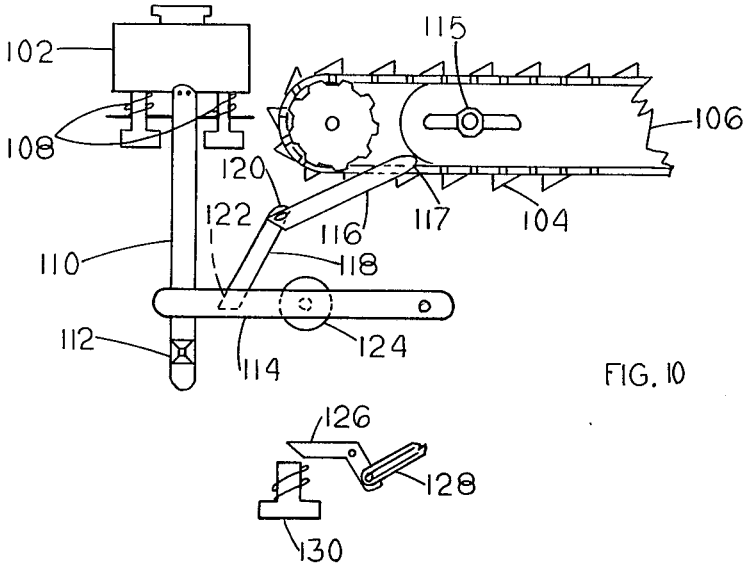
FIG. 10 is a diagramatic illustration of another embodiment of the invention for use with a tripping and reset mechanism in a chain saw.

FIG. 10 shows an embodiment of the subject tripping and reset mechanism according to the invention being used in a chain saw having a fuel tank 102 and a cutting chain 104 which is driven around a nose bar 106. The fuel tank 102 is mounted on spring loaded mounting members 108 which allows the gas tank 102 to move to different positions or levels depending on the amount of fuel in the tank 102. An activating bar 110 is attached to and moves with the fuel tank 102, and has an activating cam 112 on its end for engagement with deflection bar 114. When only a predetermined amount or less of fuel remains in the tank, the fuel tank 102 moves up until the activating cam 112 on the activating bar 110 engages the end of the deflection bar 114, activating a trigger assembly similar to that shown in FIGS. 2–6 for operating the chain saw, thereby indicating to the operator that the chain saw is low on fuel.

The chain saw has an adjustment 115 for adjusting the portion of the nose bar 106 thereby adjusting the tightness or tension by the cutting chain 104. The chain saw also includes linkage members 116 and 118 connected at 120 and having one end 117 of the member 116 positioned against the nose bar 106 and one end 122 of the member 118 positioned against the deflection bar 114. The linkage members 116 and 118 are arranged such that if the nose bar 106 moves out of adjustment allowing the chain 104 to loosen, the nose bar 106 will push against the connected linkage members 116 and 118, causing the end 122 to push against the deflection bar 114 thereby activating the annunciating trigger assembly indicating to the operator that the chain is loose.

A heat sensor 124, which may be a bellows or a bimetallic strip, is also provided and is set for sensing an overheated condition in the chain saw. The sensor 124 is located adjacent to the deflection bar 114 for engaging the deflection bar 114 and activating the annunciating trigger assembly to indicate to the operator that the chain saw has become overheated.

A reset mechanism having a reset bell crank 126 and a reset linkage 128 activated by a spring loaded reset button 130 is provided for resetting the annunciating trigger mechanism. After the annunciating trigger is activated, the operator may correct the cause of the activation by adding fuel, tightening the chain, or allowing the chain saw to cool, and then, by pushing the reset button 130, resets the mechanism by an operation similar to the reset operation described in connection with FIGS. 2–6. It will be understood by those skilled in the art that these annunciating functions are particularly advantageous when used in association with a chain saw because they warn of the impending problem, but allow the operator to continue using the saw, such as in an emergency, if he chooses to do so.

An activating scheme such as that used in conjunction with the fuel tank 102 of FIG. 10 may also be used with the paint container of a paint sprayer to indicate when the supply of remaining paint is below some predetermined amount. This allows the painter to continue to paint to some convenient breaking point before stopping to add paint thereby providing an improved painting operation and a better looking paint job.

Figure 11:
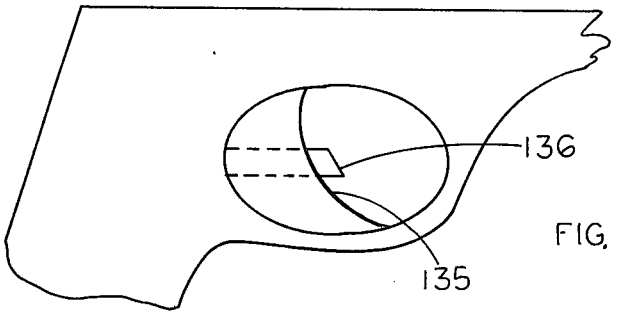
FIG. 11 is a side elevational view of yet another embodiment of an annunciating trigger construction embodying the teachings of the present invention.

FIG. 11 is a fragmentary view of the trigger portion 135 of a trigger operated device in which the trigger 135 moves linearly such as is true in some pistols, for instance the Colt Model 1911A1 pistol, and in some paint sprayers, and other devices. In these constructions, the main trigger 135 has an annunciating member such as rod 136 which is pushed to an annunciating position as shown in FIG. 11 wherein the end of the rod 136 extends forwardly beyond the main trigger 135. The amount of extension in the annunciating position can be varied as desired.

Thus there has been shown and described novel trigger assembly means which fulfill all of the objects and advantages sought therefor. It will be apparent to those skilled in the art, however, that many changes, modifications, variations, and other uses and applications for the subject device are possible. All such changes, modifications, variations, and other uses and applications which do not depart from the spirit and scope of the invention are deemed to be covered by the invention which is limited only by the claims which follow.

I claim:

1. A trigger assembly for annunciating a change in a predetermined condition of a trigger operated device comprising a main trigger member, an annunciating trigger member, biasing means between the main trigger member and the annunciating trigger member urging the main and annunciating trigger members from a normal operating position wherein the trigger members are in substantial alignment to an annunciating position wherein the annunciating trigger member is out of alignment with the main trigger member, releasable latch means engagable with at least one of the trigger members for maintaining said one trigger member in alignment with the other trigger member, and tripping means operatively engagable with said latch means and movable in response to a change in the predetermined condition of said trigger operated device for releasing said latch means to enable said biasing means to move the annunciating trigger member to its annunciating position.

2. The trigger assembly of claim 1 including reset means operable for moving the annunciating trigger member into alignment with the main trigger member, said trigger operated device including means for engaging the reset means.

3. The trigger assembly of claim 1 wherein said annunciating trigger member includes a rod extending through the main trigger member.

4. The trigger assembly of claim 3 wherein said main trigger member includes a tubular portion and said annunciating trigger member includes a rod member positioned therein.

5. The trigger assembly of claim 3 wherein said main latch means includes a spring tab movable between an inoperative and an operative position, said spring tab having a first end connected to one of the trigger members, an opposite free end, and a sidewardly extending projection intermediate the ends thereof, said spring tab being engagable by the tripping means, said projection extending from the spring tab into engagement with a selected one of the trigger members in the inoperative position of the spring tab, and movable out of engagement with said selected one trigger member under control of said tripping means.

6. The trigger assembly of claim 5 wherein said tripping means includes a deflection bar having a first end pivotally attached to the device and a second end, said deflection bar being engagable with the free end of said spring tab for moving the spring tab from its inoperative position to its operative position when said deflection bar pivots about its first end in one direction.

7. The trigger assembly of claim 6 including a carrier means on the device for receiving the carrier, a follower movable on the carrier in response to consumption of the consumables, and said follower having a projection thereon for movement into engagement with the second end of said deflection bar when a predetermined amount of said consumables remain in the carrier, said projection operative to pivotally move the deflection bar around its first end thereby also moving the spring tab to its operative position.

8. The trigger assembly of claim 7 wherein said reset means includes a reset projection extending from the side of said carrier movable along a predetermined path when said carrier is loaded into said device and a bell crank rotatably mounted on said device, said bell crank having a first end operatively connected to one of said trigger members for movement in concert therewith, and a second end movable into the path of said reset projection such that when said reset projection engages the second end, the bell crank moves the annunciating trigger member to its normal position in alignment with the main trigger member.

9. The trigger assembly of claim 1 including a cassette for supplying material in woundup form to the device, means on the device for receiving the cassette, means engagable with the material as it is drawn from the cassette for use by the device including means to sense when the remaining material in the cassette reaches a predetermined condition, and means operatively connected to said engagable means for activating said tripping means when the material remaining in the cassette reaches said predetermined condition.

10. The trigger assembly of claim 1 including means for containing a liquid to be consumed by the device, means to sense when the remaining liquid in the container means reaches a predetermined condition, and means operatively connected to said sensing means for activating said tripping means when the liquid remaining in the containing means reaches said predetermined condition.

11. The trigger assembly of claim 1 including means to sense when the temperature of the device reaches a predetemined condition, and means operatively connected to said temperature sensing means for activating said tripping means when the temperature of said device reaches said predetermined condition.

12. The trigger assembly of claim 1 including a cutting chain operable by the device, means to sense when the cutting chain reaches a predetermined condition, and means operatively connected to said sensing means for activating said tripping means when the cutting chain reaches said predetermined condition.

13. A firearm comprising a frame having a chamber for receiving a supply of ammunition into the firearm, a clip movable into said chamber, said clip having a follower engagable with the last to be used round of ammunition remaining in said clip, a spring in said clip biasing said follower in a direction to push ammunition into firing position in the firearm, a cam member on said follower projecting from the clip and movable with said follower, a deflection bar having a free end and a second end including connection means for pivotally engaging the second end with said frame, the free end of said deflection bar being positioned to be engaged by the cam member when a predetermined number of rounds of ammunition remain in said clip, said cam member pivotally moving said deflection bar, a pair of adjacent trigger members mounted on said frame and movable between a normal position wherein said trigger members are in alignment and an annunciating position wherein said trigger members are angularly displaced relative to each other, a releasable catch engagable with at least one of the trigger members for maintaining the trigger members in their normal aligned condition, and a tab member having a first portion engagable with said deflection bar and a second portion positioned to disengage said releasable catch from said one trigger member when the first portion of the tab is moved by engagement with the deflection bar.

14. The firearm of claim 13 further comprising a reset projection on one side of said clip in position to move along a predetermined path as said clip is moved into and out of said chamber, a trigger reset member pivotally mounted on said frame and having a portion extending into the pathway of said reset projection to be engaged thereby when a clip is inserted into the chamber, and a linkage connecting said reset member to one of said trigger members for moving said one trigger member to restore the trigger members to their normal aligned condition when a push clip is inserted in the chamber.

15. The firearm of claim 14 wherein said linkage member includes lost-motion means operable during one direction of movement of the clip in the chamber.

16. A method of annunciating a change in a trigger operated device from an initial condition comprising providing said device with a trigger having two relatively movable trigger portions, aligning said trigger portions, sensing a change in some condition of the trigger operated device, and moving one of said trigger portions out of alignment with the other trigger portion in response to a predetermined change in the condition being sensed, said trigger operated device being a firearm and the condition being sensed is the remaining supply of ammunition in the firearm.

17. The method of claim 16 further comprising realigning said trigger portions to their aligned condition in response to restoring the initial condition of the device.

* * * * *